US005666684A

United States Patent [19]

Cussen

[11] Patent Number: 5,666,684

[45] Date of Patent: Sep. 16, 1997

[54] GOLF CLUB CLEANER

[76] Inventor: Michael Cussen, 11 Rosalie Court, Pakenham, Victoria 3810, Australia

[21] Appl. No.: 597,646

[22] Filed: Feb. 6, 1996

[30] Foreign Application Priority Data

Feb. 14, 1995 [AU] Australia ..... PN1130
Dec. 12, 1995 [AU] Australia ..... 40354/95

[51] Int. Cl.[6] ..... A63B 57/00

[52] U.S. Cl. ..... 15/104.92; 15/104.93; 15/114; 15/160

[58] Field of Search ..... 15/21.2, 104.92, 15/104.93, 104.94, 114, 160

[56] References Cited

U.S. PATENT DOCUMENTS

| | | | |
|---|---|---|---|
| 1,920,960 | 8/1933 | Cogsdill | 15/21.2 |
| 2,672,633 | 3/1954 | Allen | 15/114 |
| 2,672,637 | 3/1954 | Allen | 15/160 |
| 3,748,676 | 7/1973 | Warren et al. | 15/104.92 |
| 3,813,722 | 6/1974 | Sapochinik | 15/114 |
| 4,069,536 | 1/1978 | Martz et al. | 15/104.92 |
| 4,473,917 | 10/1984 | Britton | 15/160 |
| 4,821,358 | 4/1989 | Wyckoff et al. | 15/104.92 |

FOREIGN PATENT DOCUMENTS

| | | | |
|---|---|---|---|
| 10924/88 | 11/1989 | Australia . | |
| 61459/90 | 11/1993 | Australia . | |
| 8283 | of 1897 | United Kingdom | 15/21.2 |
| 90/07958 | 7/1990 | WIPO . | |
| 94/13367 | 6/1994 | WIPO . | |

*Primary Examiner*—Mark Spisich
*Attorney, Agent, or Firm*—Ladas & Parry

[57] ABSTRACT

A golf club cleaner has a receptacle having a closed bottom end, a side wall and an opening at the top end for receiving the head of a golf club to be cleaned. An absorbent provided adjacent the bottom of the receptacle for receiving cleaning liquid and a multiplicity cleaning bristles disposed within the receptacle for contacting the head of the golf club when it is inserted into the receptacle.

14 Claims, 2 Drawing Sheets

GOLF CLUB CLEANER

The invention relates to Golf Club cleaning device.

The playing performance of golf clubs including woods and irons, may be seriously impaired by the presence of dirt or foreign materials, such as grass, on the club head. For this reason many golfers carry a towel so that the club head can be wiped clean after each shot. Due to the flow of play, however, it is often not convenient to use the towel to properly clean a club after a shot particularly on the approach to the green. Furthermore, even when a towel is used foreign matter tends to build up on the club head particularly in the grooves of irons which have an important function in providing the desired flight characteristics to the golf ball.

It is the object of the invention to provide a golf club cleaning device which is convenient to use and provides efficient cleaning of club heads.

In accordance with the invention we provide a golf club cleaner including a receptacle having a closed bottom end, a side wall and an opening at the top end for receiving the head of a golf club to be cleaned; absorbent means provided adjacent the bottom of the receptacle for receiving cleaning liquid; and a multiplicity cleaning bristles disposed within the receptacle for contacting the head of the golf club when it is inserted into the receptacle.

The bristles are generally substantially transversally disposed within the receptacle such that the distal ends of the bristles engage the club head on inserting the club head into the receptacle. The club head is typically cleaned by a reciprocating motion of the club head in the receptacle in which the head of the golf club is engaged by the bristles on passage of the club head to the bottom of the vessel and during withdrawal of the golf club. The cleaning bristles are generally in the form of an array of transversely disposed bristles which array preferably extends longitudinally within the vessel. The absorbent means may be used to retain a cleaning liquid which may be water or a detergent solution. The absorbent means preferably provides a stop for the golf club head to precent damage to the container base and also distributes a cleaning liquid onto the club head and/or the bristles, particularly when the club head strikes the absorbent means.

The golf club cleaner preferably includes a bristle retaining means, such as a brush head, for retaining an longitudinally disposed array of bristles adjacent the side wall of the vessel such that the ends of the bristles extend towards the interior of the vessel and away from the wall.

The bristle retaining means may be removably attachable to the inside of the wall of the vessel to enable the array of bristles to be removed, cleaned and then replaced.

In a preferred embodiment the golf club cleaner includes at least two brushes which may be elongated and longitudinally disposed and retained adjacent the receptacle wall. In this embodiment the free ends of the bristles of respective brushes are preferably opposed and the bristles are resiliently deformable to allow the passage of a club head between the brushes to effect cleaning. Preferably there are two brushes the free ends of the bristles of respective brushes providing cleaning surfaces such that the one of the brushes will contact the face of the club head and generally the opposed brush will contact the back side of the club head. The cleaning surfaces may abut each other or may be spaced apart. The cleaning surfaces may be parallel or alternatively they may converge toward the bottom of the container. The need for and degree of spacing between the cleaning surfaces may be chosen together with bristle resilience to provide abrasion to the club face. Typically the spacing will be from 0 mm to 20 mm. To provide correct orientation of the club when a pair of opposed brushes are used it is preferred to provide an elongated opening for admitting the base (or foot) of the club head in an orientation for passage between the brushes so that the face of the club head is engaged by one of the brushes and the back of the club head is engaged by the opposed brush.

In a preferred embodiment of the invention brushes are retained in channels within the receptacle. Longitudinally extending channels may be provided in the walls of the receptacle for receiving the heads of at least two brushes such that the ends of the bristles of respective brushes are opposed. Each channel preferably retains the brush head so that it is slidable within the channel. Each channel is typically defined by a pair of longitudinally extending protrusions on the inside of the receptacle which protrusions converge such that their distal ends are located on the underside of the brush head thereby retaining the brush head in the channel.

The receptacle may be of any suitable cross section such as circular square cross shaped or the like.

The bristles may be constructed from any suitable materials and the materials and length and resilience of the bristles is preferably such that they are resilient deformed in response to reciprocating motion of the club head of the golf club within the receptacle.

The open end of the vessel may be provided with a divergent flange which narrowingly tapers toward the lower end to guide the club head into the receptacle.

The receptacle preferably has an annular side wall and the flange may be adapted to be removably attended to the side wall by means of corresponding lip on the inner circumference of the flange and radial groove adjacent the upper end of the wall.

The golf club cleaner may also be provided with retaining means for fixing the receptacle to a golf buggy.

A preferred embodiment of the invention will now be described with reference to the attached drawings. In the drawings.

Figure 1:
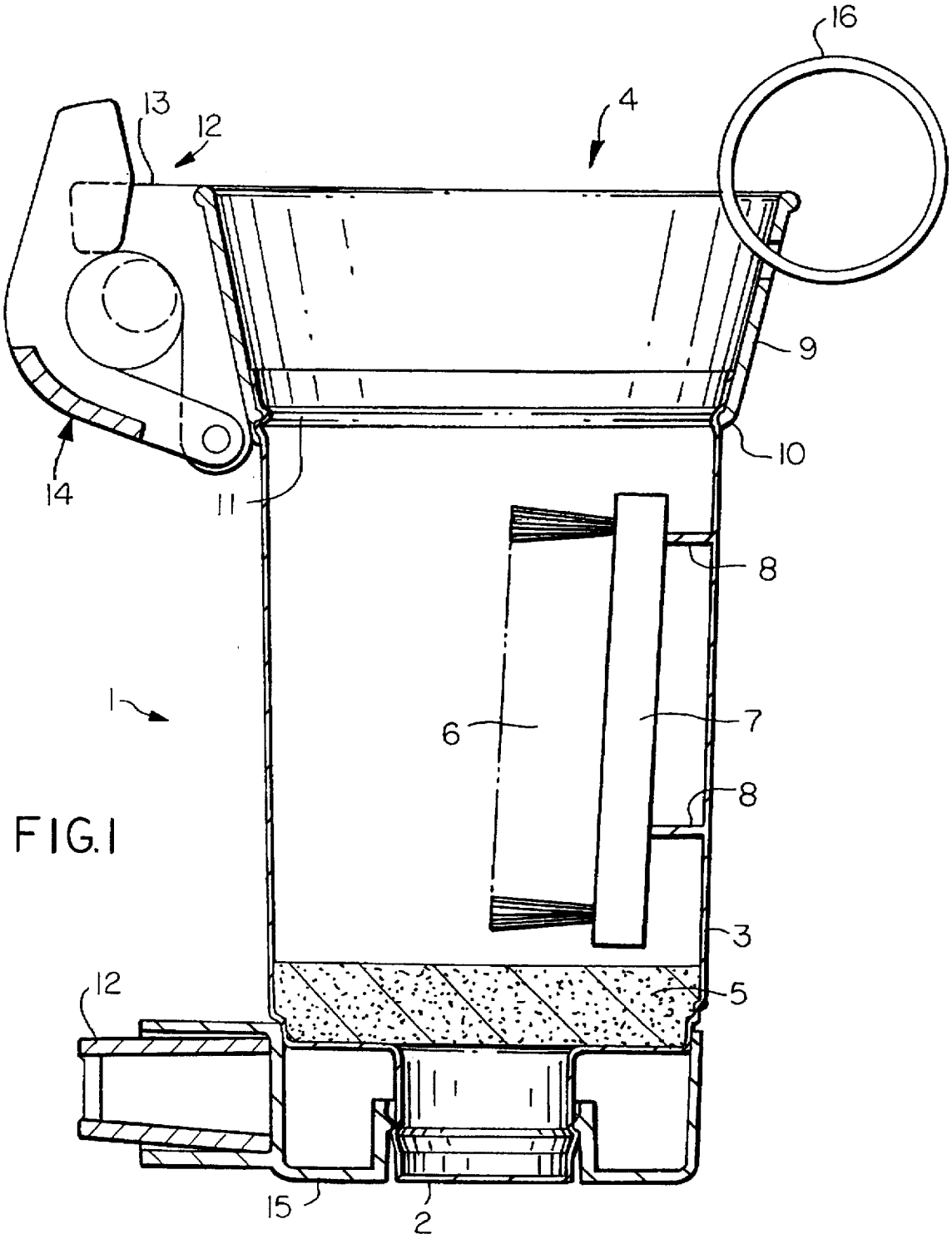
FIG. 1 is a longitudinal section of a golf club cleaner of the invention.

In FIG. 1 there is shown a golf club cleaner (1) having a closed bottom end (2) elongated side wall (3); and an open top end (4) for admitting the head of a golf club. Liquid absorbent means (5) is located adjacent the close end (2) of the container and a brush provides an array of transversely disposed bristles (6) the array extending longitudinally from adjacent the absorbent means (5) toward the top end (4). The bristles (6) are retained adjacent to the container wall (3) by elongated bush head (7) extending along the inside of the container wall and which is removably attachable to the side wall of the container by attachment means (8) such as screws clips or a locking nut extending through the wall of the container (3). Alternatively, a mounting bracket may be provided. The absorbent means (5) may be a sponge extending from the bottom of the container upward adjacent the lower end of the array of bristles (6). This is particularly preferred as impact of the head of the club on the absorbent means (5) during cleaning provides effective distribution of the absorbent liquid on to the brush and club head and the bristles simultaneously provide an abrasive force to the club head removing dirt or foreign matters such as grass. In operation, cleaning is provided by longitudinal movement of the golf club with the head disposed in the vessel such that ends of the bristle (6) engaged in the club head and the impact of the club head on the absorbent means (5) distributes cleaning liquid on to the club end and bristles to aid in cleaning.

The upper end of the container wall is provided with a flange (9) which is preferably frustoconical and downwardly converges to guide the club head into the container for cleaning. The flange (9) may be detachable from the container side wall (3). The lower end of the flange portion may include a inwardly disposed lip (10) to be received in a corresponding groove (11) extending about the upper end of the container wall. The flange (9) and bottom (2) may be provided with retaining clips (12) for fastening the cleaner to a golf bag or buggy. The clip on the flange portion (9) may include a portion (13) extending laterally from the container or flange (9) for locating over a horizontal tubular section on the upper part of a buggy and a pivoting arm (14) the arm and laterally extending portion (13) including interlocking means to allow the arm (14) to be removably attached to the outwardly extending portion (13) to retain the horizontal tubular section there between and adjacent the side of the container (3) or flange (9). The retaining clip (12) adjacent the bottom (2) of the container may include a pair of resilient coacting arms adapted to be located either side of vertical tabular portion of a buggy. The coacting arms may be provided with ribs on their facing sides for engaging the vertical tabular portion.

The retaining clip (12) adjacent the bottom (2) of the container may be provided as a mounting (15) for receiving the bottom end of the container (2). Other retaining means may be provided by a ring (16) extending through the flange portion 9 at the top of the container.

Figure 3:
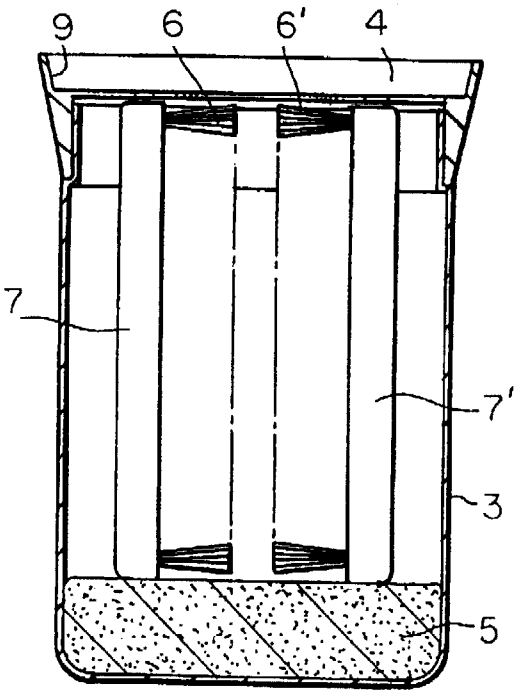
FIG. 3 is a longitudinal section of the golf club cleaning of FIG. 2 along the line III—III.
Figure 4:
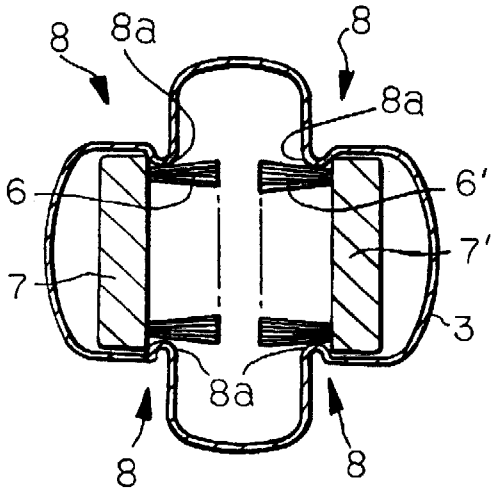
FIG. 4 is a cross-section of the golf club cleaner of FIG. 2 along the line IV—IV.
Figure 2:
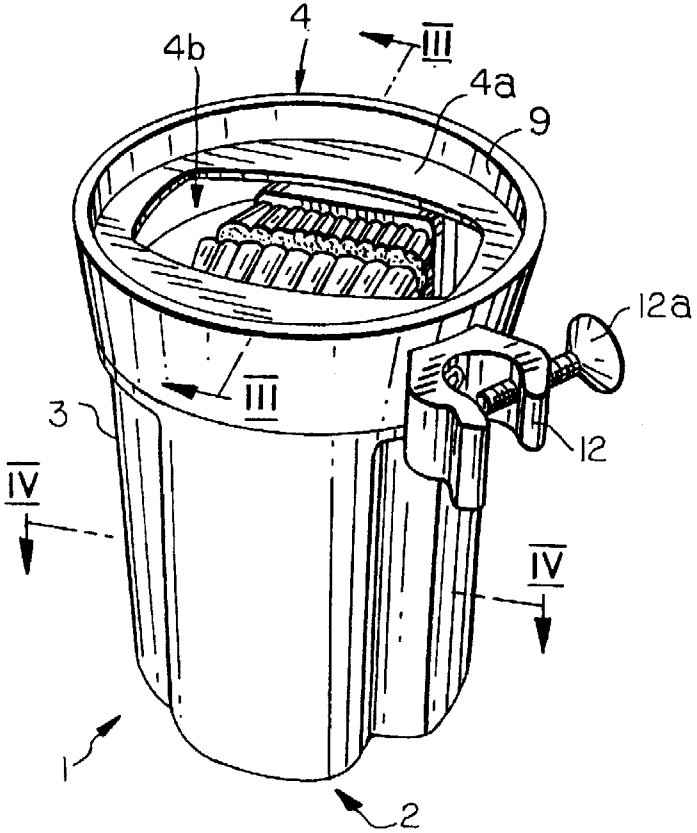
FIG. 2 is a further embodiment of a golf club cleaner of the invention.

Referring to FIGS. 2 to 4 there is shown a further embodiment of a golf club cleaner (1) of the invention which has a receptacle with a closed bottom end (2) a side wall (3) and a top end (4) including a lid (4*a*), which provides an opening (4*b*) for receiving a club head from the base (foot) end first. Two brushes are provided comprising brush heads (7,7') retained adjacent the container wall and bristles (6,6') extending inward the two sets of bristles (6,6') define opposed parallel cleaning surfaces generally shown in FIG. 2. The opening (4*b*) in the lid (4*a*) is generally oriented to provide passage between the brushes by deforming the two sets of bristles (6,6'). The brushes heads (7,7') are retained in channels defined by protrusions (8*a*) formed in (and integral with) the receptacle wall which extend longitudinally on the inside of the receptacle. The distal ends of the protrusions (8) converge and are located on the underside of brush head (7,7') to retain the brush head (7,7') adjacent the receptacle wall (3). The lid of the receptacle (4*a*) and the upper end of the receptacle side wall (3) include corresponding threaded portions (not shown) so that the lid may be removably engage the receptacle side wall (3).

The absorbent means (5) retains cleaning liquid and is resilient making contact with the lower end of the array of bristles (6,6') and the lower end of the brush head (7,7') to urge the brush head (7,7') upward so that it is retained between the underside of the lid (4) and the absorbent means (5). This avoids undue sliding and movement of the brush heads (7,7') and bristles (6,6') during cleaning. Lateral movement may also be restricted by providing bristles long enough so that the bristles of respective brushes about one another and yet are resilient enough to allow passage of the club head.

To clean a club the club is passed base (or foot) first into the opening (4*b*). The opening is elongated in alignment with the passage between the opposed bristles (6,6') so that the foot passes between the bristles (6,6') and one set of bristles (6,6') engages the back of the club. The club head can be forced to the bottom of the container and the absorbent means provides a stop for the club head. The inpact of the club head on the absorbent means (5) serves to distribute cleaning liquid absorbed therein onto the club head and bristles (6,6') to aid in cleaning.

The golf club cleaner is provided with a clip (12) for receiving a tubular upwardly extending frame member of a golf buggy so that the open end (4) of the cleaner is disposed upward. The clip (12) may also be provided with a screw fitting (12*a*) which cooperates with the clip to fasten the clip to the upwardly extending tubular member. The golf club cleaner may be adapted to allow the golf club to be retained supported within the receptacle while the buggy is moved.

The adsorbent means is preferably a resilient sponge and may be constructed of a synthetic foam material such as the polyurethane foam or a natural sponge material. The bristles may be constructed in any suitable material such as metal, natural fibre or plastic or other synthetic fibre. Plastic synthetic, fibre is particularly convenient. It is particularly preferred that the length and diameter ratio of the receptacle and length of the bristles are such that a golf club is retained in the golf club cleaner without further support when the cleaner is disposed at an angle of 40° from a vertical and the club head is adjacent the sponge. The golf club cleaner of the invention will preferably allow the golf club to be supported in a cleaner while a cleaner is attached to a buggy so that the golf can be placed with club head inside the cleaner and retained within the cleaner while the buggy is transported between shots. The cleaner is most preferably in the range of from 150 mm to 300 mm in length and from 100 mm to 150 mm in diameter. The array of brittles will preferably extend at least 50 mm longitudinally with a receptacle and preferably less than 100 mm and will preferably be at least 20 mm wide. The bristles may extend about the complete inner circumference of the vessel however generally the array of bristles will be no more than 80 mm wide. The length of the bristles may be for example in the range of 10 mm to 40 mm.

The golf club cleaner of the invention may be constructed in a light weight synthetic plastic material and absorbent means at the bottom of the cleaner allows efficient cleaning to be carried out with a minimum of cleaning liquid. The cleaner can be attached to the frame of the golf buggy from the support provided on most commercially available buggies or the supports provided on commercially available golf bags. Alternatively the cleaner may be incorporated into a golf bag or buggy or where the buggy is sufficiently large, such as in motorised vehicles, the golf cleaner may be retained in an upright position. It is an advantage of the invention that the club head may be cleaned by simply pushing the club head into the cleaner and removing it. The cleaner need not be handled and the club can be left supported in the cleaner between shots.

Finally, it is to be understood that various other modifications and/or alterations may be made without departing from the spirit of the present invention as outlined herein.

I claim:

1. A golf club cleaner comprising:

a receptacle having a closed bottom end, a longitudinal side wall and a top end provided with an opening for receiving a golf club head to be cleaned;

absorbent means adjacent the bottom end for receiving cleaning liquid; and at least two brushes, each of the brushes including a brush head and a multiplicity of cleaning bristles extending from the brush head to free ends, the brush head being retained adjacent an interior of the longitudinal side wall with the cleaning bristles extending inwardly from one side of the brush head such that the free ends of the cleaning bristles of the respective brushes are opposed for contacting the golf club head when it is received through the opening and inserted into the receptacle between the brushes.

2. The golf club cleaner according to claim 1 wherein the bristles are substantially transverse to the longitudinal side wall.

3. The golf club cleaner according to claim 1 wherein the cleaning bristles are resiliently deformed when contacting the golf club head.

4. The golf club cleaner according to claim 3 wherein the free ends of the cleaning bristles of the brushes provide parallel cleaning surfaces.

5. The golf club cleaner according to claim 1 wherein the opening is elongated transversely to the longitudinal side wall in an orientation such that a face and back of the golf club head are contacted by the cleaning bristles of the brushes.

6. The golf club cleaner according to claim 1 including at least two longitudinally extending channels in the longitudinal side wall respectively for slidably receiving the brush heads.

7. The golf club cleaner according to claim 6 wherein each one of the channels is defined by a pair of longitudinally extending protrusions on the longitudinal side wall, the protrusions converging toward each other to engage the one side of a complementary one of the brush heads to retain the one of the brush heads in the one of the channels.

8. The golf club cleaner according to claim 7 wherein the protrusions are integral with the longitudinal side wall.

9. The golf club cleaner according to claim 8 wherein the protrusions are formed by the longitudinal side wall.

10. The golf club cleaner according to claim 1 wherein the absorbent means contacts the brushes.

11. The golf club cleaner according to claim 1, and further comprising a removable lid having an underside for closing the opening, wherein each brush head is movably retained adjacent the interior of the longitudinal side wall and the absorbent means is resilient for urging the brushes against the underside of the lid.

12. The golf club cleaner according to claim 11 wherein the lid and longitudinal side wall include cooperating engaging means.

13. The golf club cleaner according to claim 1 and further comprising attachment means for removably attaching the receptacle to a golf buggy such that the opening is upwards.

14. The golf club cleaner according to claim 13 wherein the attachment means comprises clip means for receiving an upwardly extending tubular member of the golf buggy and a screw which cooperates with the clip means to fasten the upwardly extending member in the clip means.

* * * * *